US011842694B2

(12) United States Patent
Hong

(10) Patent No.: US 11,842,694 B2
(45) Date of Patent: Dec. 12, 2023

(54) DISPLAY DEVICE

(71) Applicant: LG Display Co., Ltd., Seoul (KR)

(72) Inventor: MooKyoung Hong, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 17/977,828

(22) Filed: Oct. 31, 2022

(65) Prior Publication Data

US 2023/0215382 A1 Jul. 6, 2023

(30) Foreign Application Priority Data

Dec. 31, 2021 (KR) ..... 10-2021-0194569

(51) Int. Cl.
*G09G 3/3275* (2016.01)
*G09G 3/3266* (2016.01)
*G09G 3/3233* (2016.01)

(52) U.S. Cl.
CPC ..... *G09G 3/3275* (2013.01); *G09G 3/3233* (2013.01); *G09G 3/3266* (2013.01); *G09G 2300/0413* (2013.01); *G09G 2300/0426* (2013.01); *G09G 2300/0819* (2013.01); *G09G 2300/0842* (2013.01); *G09G 2310/08* (2013.01); *G09G 2320/029* (2013.01); *G09G 2320/0233* (2013.01); *G09G 2320/045* (2013.01)

(58) Field of Classification Search
None
See application file for complete search history.

(56) References Cited

U.S. PATENT DOCUMENTS

2010/0073346 A1* 3/2010 Min ..... G09G 3/3291 345/211
2018/0151121 A1* 5/2018 Lim ..... G09G 3/2081
2022/0044641 A1* 2/2022 Park ..... G09G 3/3275

FOREIGN PATENT DOCUMENTS

KR 10-2017-0054654 A 5/2017
KR 10-2019-0032807 A 3/2019
KR 10-2019-0048397 A 5/2019

* cited by examiner

*Primary Examiner* — Chineyere D Wills-Burns
*Assistant Examiner* — Amen W Bogale
(74) *Attorney, Agent, or Firm* — Fenwick & West LLP

(57) ABSTRACT

A display device is disclosed that includes: a display panel on which a plurality of pixels are disposed; a data driver configured to receive a sensing voltage from a reference voltage line connected to the plurality of pixels, convert the reference voltage into sensing data, and supply the data voltage to the plurality of pixels; a gate driver configured to supply a scan signal to the plurality of pixels; and a timing controller configured to output a data control signal for controlling an output timing of the data voltage and output a gate control signal for controlling an output timing of the scan signal, wherein one of the output timing of the data voltage and the output timing of the scan signal is adjusted based on the sensing data.

18 Claims, 12 Drawing Sheets

DISPLAY DEVICE

CROSS-REFERENCE TO RELATED APPLICATIONS

This application claims the priority of Republic of Korea Patent Application No. 10-2021-0194569 filed on Dec. 31, 2021, in the Korean Intellectual Property Office, the disclosure of which is incorporated by reference in its entirety.

BACKGROUND

Field

The present disclosure relates to a display device, and more particularly, to a display device capable of compensating for degradation.

Description of the Related Art

As display devices used for a monitor of a computer, a television (TV) set, a mobile phone, and the like, there are an organic light-emitting display (OLED) configured to autonomously emit light, and a liquid crystal display (LCD) that requires a separate light source to emit light.

Among the various display devices, the organic light-emitting display device includes: a display panel including a plurality of subpixels; and a drive unit configured to operate the display panel. The drive unit includes: a gate driver configured to supply a scan signal to the display panel; and a data driver configured to supply a data voltage. When signals such as the scan signal and the data voltage are supplied to the subpixels of the organic light-emitting display device, the selected subpixels may emit light, thereby displaying images.

SUMMARY

As the operating time of each of the pixels increases, a circuit element such as a driving transistor degrade. Therefore, an inherent characteristic value of the circuit element such as the driving transistor may change. Therefore, a change in the characteristic value of the circuit element may cause a change in brightness of the pixel.

An object to be achieved by the present disclosure is to provide a display device capable of compensating for degradation.

Another object to be achieved by the present disclosure is to provide a display device capable of controlling a data charging rate in accordance with a rate of change in characteristic value of a circuit element.

Objects of the present disclosure are not limited to the above-mentioned objects, and other objects, which are not mentioned above, can be clearly understood by those skilled in the art from the following descriptions.

In one embodiment, a display device comprises: a display panel including a plurality of pixels; a data driver configured to receive a sensing voltage from a reference voltage line connected to the plurality of pixels, convert the sensing voltage into sensing data, and supply data voltages to the plurality of pixels; a gate driver configured to supply a scan signal to the plurality of pixels; and a timing controller configured to output a data control signal that controls an output timing of the data voltage and output a gate control signal that controls an output timing of the scan signal, wherein one of the output timing of the data voltage and the output timing of the scan signal is adjusted based on the sensing data.

In one embodiment, a display device comprises: a display panel including a plurality of pixels; a data driver configured to supply data voltages to the plurality of pixels and generate sensing data indicative of a characteristic value of a pixel of the plurality of pixels based on a sensed voltage of the pixel received from a reference voltage line that is connected to the pixel; a gate driver configured to supply a scan signal to the plurality of pixels; and a timing controller configured generate compensation data that compensates the characteristic value of the pixel and adjusts an amount of overlap time that a data voltage for the pixel is output while the scan signal is also output to the pixel based on the compensation data.

In one embodiment, a display device comprises: a display panel including a plurality of first pixels configured not to emit light and a plurality of second pixels configured to emit light; a data driver configured to supply data voltages to the plurality of first pixels and the plurality of second pixels, and generate first sensing data indicative of first characteristic values of the plurality of first pixels, and generate second sensing data indicative of second characteristic values of the plurality of second pixels; a gate driver configured to supply scan signals to the plurality of first pixels and the plurality of second pixels; and a timing controller configured to determine amounts of overlap time that first data voltages for the plurality of first pixels are output while first scan signals are also output to the plurality of first pixels based on the first sensing data, and adjust an amount of overlap time that a second data voltage for a second pixel from the plurality of second pixels is output while a scan signal is also output to the second pixel based on at least the determined amounts of overlap time for the plurality of first pixels that do not emit light.

Other matters of the exemplary embodiments are included in the detailed description and the drawings.

The present disclosure may compensate for the degradation by changing the turn-on timing of the scan signal and the output timing of the data voltage.

The present disclosure may compensate for the output brightness by controlling the data charging rate.

The effects according to the present disclosure are not limited to the contents exemplified above, and more various effects are included in the present specification.

BRIEF DESCRIPTION OF THE DRAWINGS

The above and other aspects, features and other advantages of the present disclosure will be more clearly understood from the following detailed description taken in conjunction with the accompanying drawings, in which.

DETAILED DESCRIPTION

Figure 1:
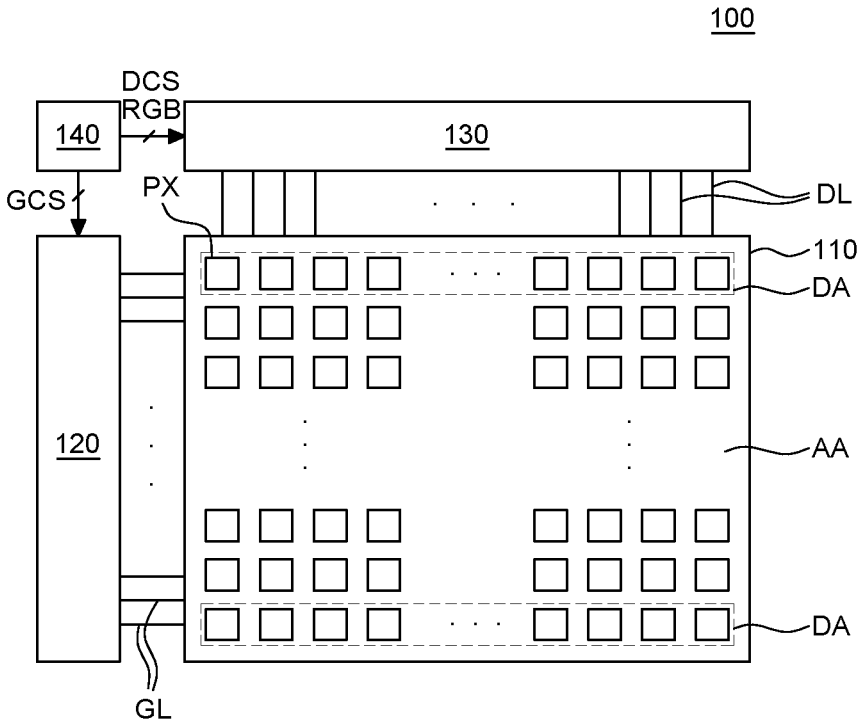
FIG. 1 is a schematic view of a display device according to an embodiment of the present disclosure.

Advantages and characteristics of the present disclosure and a method of achieving the advantages and characteristics will be clear by referring to exemplary embodiments described below in detail together with the accompanying drawings. However, the present disclosure is not limited to the exemplary embodiments disclosed herein but will be implemented in various forms. The exemplary embodiments are provided by way of example only so that those skilled in the art can fully understand the disclosures of the present disclosure and the scope of the present disclosure. Therefore, the present disclosure will be defined only by the scope of the appended claims.

The shapes, sizes, ratios, angles, numbers, and the like illustrated in the accompanying drawings for describing the exemplary embodiments of the present disclosure are merely examples, and the present disclosure is not limited thereto. Like reference numerals generally denote like elements throughout the specification. Further, in the following description of the present disclosure, a detailed explanation of known related technologies may be omitted to avoid unnecessarily obscuring the subject matter of the present disclosure. The terms such as "including," "having," and "comprising" used herein are generally intended to allow other components to be added unless the terms are used with the term "only". Any references to singular may include plural unless expressly stated otherwise.

Components are interpreted to include an ordinary error range even if not expressly stated.

When the position relation between two parts is described using the terms such as "on", "above", "below", and "next", one or more parts may be positioned between the two parts unless the terms are used with the term "immediately" or "directly".

When an element or layer is disposed "on" another element or layer, the element or layer may be directly on another element or layer or other elements or layers may be interposed therebetween.

Although the terms "first", "second", and the like are used for describing various components, these components are not confined by these terms. These terms are merely used for distinguishing one component from the other components. Therefore, a first component to be mentioned below may be a second component in a technical concept of the present disclosure.

Like reference numerals generally denote like elements throughout the specification.

A size and a thickness of each component illustrated in the drawing are illustrated for convenience of description, and the present disclosure is not limited to the size and the thickness of the component illustrated.

The features of various embodiments of the present disclosure can be partially or entirely adhered to or combined with each other and can be interlocked and operated in technically various ways, and the embodiments can be carried out independently of or in association with each other.

Transistors used for a display device according to the present disclosure may be implemented as one or more transistors among n-channel transistors (NMOS) and p-channel transistors (PMOS). The transistor may be implemented as an oxide semiconductor transistor having an active layer made of an oxide semiconductor or a low-temperature polysilicon (LTPS) transistor having an active layer made of low-temperature polysilicon (LTPS). The transistor may at least include a gate electrode, a source electrode, and a drain electrode. The transistor may be implemented as a thin-film transistor (TFT) on a display panel. In the transistor, carriers flow from the source electrode to the drain electrode. Because the carrier is the electron in the n-channel transistor (NMOS), a source voltage is less than a drain voltage so that the electrons flow from the source electrode to the drain electrode. In the n-channel transistor (NMOS), the current may flow from the drain electrode to the source electrode, and the source electrode may be an output terminal. Because the carrier is the positive hole in the p-channel transistor (PMOS), a source voltage is greater than a drain voltage so that the positive holes flow from the source electrode to the drain electrode. Because the positive holes flow from the source electrode to the drain electrode in the p-channel transistor (PMOS), the current may flow from the source to the drain, and the drain electrode may be an output terminal. Therefore, it could be noted that the source and the drain of the transistor are not fixed because the source and the drain may be changed in accordance with an applied voltage. The present specification is described on the assumption that the transistor is the n-channel transistor (NMOS). However, the present disclosure is not limited thereto. The p-channel transistor may be used as the transistor. Therefore, the circuit configuration may be changed.

A gate signal of the transistor using switch elements swings between a turn-on voltage and a turn-off voltage. The turn-on voltage is set to a voltage greater than a threshold voltage Vth of the transistor. The turn-off voltage is set to a voltage less than the threshold voltage Vth of the transistor. The transistor is turned on in response to the turn-on voltage. In contrast, the transistor is turned off in response to the turn-off voltage. In the case of the NMOS, the turn-on voltage may be a high voltage, and the turn-off voltage may be a low voltage. In the case of the PMOS, the turn-on voltage may be a low voltage, and the turn-off voltage may be a high voltage.

Hereinafter, various embodiments of the present disclosure will be described in detail with reference to the accompanying drawings.

FIG. 1 is a schematic view of a display device according to an embodiment of the present disclosure.

Referring to FIG. 1, a display device 100 includes a display panel 110, a gate driver 120, a data driver 130, and a timing controller 140.

The display panel 110 is a panel configured to display images. The display panel 110 may include various circuits, lines, and light-emitting elements disposed on a substrate. The display panel 110 may include a plurality of pixels PX defined by a plurality of data lines DL and a plurality of gate lines GL that intersect one another. The plurality of pixels PX is connected to the plurality of data lines DL and the plurality of gate lines GL. The display panel 110 may include a display area defined by the plurality of pixels PX, and a non-display area in which various types of signal lines or various pads are formed. The display panel 110 may be implemented as the display panel 110 used for various display devices such as a liquid crystal display device, an organic light-emitting display device, and an electrophoretic display device. Hereinafter, the configuration will be described in which the display panel 110 is a panel used for an organic light-emitting display device. However, the present disclosure is not limited thereto.

The timing controller 140 receives timing signals such as a vertical synchronizing signal, a horizontal synchronizing signal, a data enable signal, and a dot clock signal through a receiving circuit such as an LVDS or TMDS interface connected to a host system. Based on the inputted timing signal, the timing controller 140 generates data control signals DCS for controlling the data driver 130 and gate control signals GCS for controlling the gate driver 120.

For example, to control the gate driver 120, the timing controller 140 outputs various gate control signals (GCSs) including a gate start pulse (GSP), a gate shift clock (GSC), and a gate output enable (GOE) signal.

In this case, the gate start pulse controls operation start timing of one or more gate circuits that constitute the gate driver 120. The gate shift clock is a clock signal inputted in common to the one or more gate circuits and controls shift timing of a scan signal (gate pulse). The gate output enable signal assigns timing information of the one or more gate circuits.

In addition, to control the data driver 130, the timing controller 140 outputs various data control signals (DCSs) including a source start pulse (SSP), a source sampling clock (SSC), and a source output enable (SOE) signal.

In this case, the source start pulse controls data sampling start timing of the one or more data circuits that constitute the data driver 130. The source sampling clock is a clock signal for controlling the sampling timing of data for each data circuit. The source output enable signal controls output timing of the data driver 130.

Further, the timing controller 140 processes the frame data inputted from the outside so that the frame data are suitable for the size and resolution of the display panel 110. The timing controller 140 converts the frame data into image data RGB and supplies the image data RGB to the data driver 130.

Further, the timing controller 140 senses characteristic values (mobility, threshold voltage) of the driving transistor disposed on each of the plurality of pixels PX and generates compensation data for the characteristic values (mobility, threshold voltage) of the driving transistor. Further, the timing controller 140 may generate the data control signal DCS and the gate control signal GCS by using the compensation data.

The data driver 130 supplies data voltages Vdata to the plurality of pixels PX. The data driver 130 may include a source printed circuit board and a plurality of source drive integrated circuits. The plurality of source drive integrated circuits may each receive the image data RGB and the data control signal DCS from the timing controller 140 through the source printed circuit board.

The data driver 130 may generate the data voltage Vdata by converting the image data RGB into a gamma voltage in response to the data control signal DCS. The data driver 130 may supply the data voltage Vdata through the data line DL of the display panel 110.

Further, the data driver 130 may receive a sensing voltage from the plurality of pixels PX and convert the sensing voltage into sensing data in respect to the characteristic values (mobility, threshold voltage) of the driving transistor. Further, the data driver 130 may output the sensing data to the timing controller 140.

The plurality of source drive integrated circuits may be provided in the form of a chip-on-film (COF) and connected to the data line DL of the display panel 110. More specifically, the plurality of source drive integrated circuits may each be provided in the form of a chip disposed on a connection film. A line connected to the source drive integrated circuit in the form of a chip may be formed on the connection film. However, the arrangement shape of the plurality of source drive integrated circuits is not limited thereto. The plurality of source drive integrated circuits may be connected to the data line DL of the display panel 110 in a chip-on-glass (COG) or tape automated bonding (TAB) process.

The gate driver 120 supplies scan signals to the plurality of pixels PX. The gate driver 120 may include a level shifter and a shift register. The gate driver 120 may be formed by a gate-in-panel (GIP) method in the non-display area of the display panel 110. However, the present disclosure is not limited thereto. The gate driver 120 may include a plurality of stages configured to shift the scan signal to correspond to the gate clock signal and the gate control signal GCS and outputs the scan signal. The plurality of stages included in the gate driver 120 may sequentially output the scan signal through a plurality of output ports.

The display panel 110 may include the plurality of pixels PX. The plurality of pixels PX may include subpixels that emit light beams with different colors. For example, the plurality of subpixels may include a red subpixel, a green subpixel, a blue subpixel, and a white subpixel. However, the present disclosure is not limited thereto. The plurality of subpixels may constitute the pixel PX. That is, the red subpixel, the green subpixel, the blue subpixel, and the white subpixel may constitute a single pixel PX. The display panel 110 may include the plurality of pixels PX.

Further, in the display device according to the embodiment of the present disclosure, the display panel 110 includes a display area AA in which light-emitting pixels are disposed, and a dummy area DA in which non-light-emitting pixels are disposed.

The display area AA is a region in which the light-emitting pixels, among the plurality of pixels PX, are disposed and implement images. Further, the dummy area DA means a region in which non-light-emitting pixels, among the plurality of pixels PX, are disposed, and no image is implemented. However, it is possible to calculate the sensing data by sampling the sensing voltage from the non-light-emitting pixels disposed in the dummy area DA. Further, FIG. 1 illustrates that the dummy area DA is a region in which the pixel PX in the uppermost line of the display panel 110 is disposed, and the pixel PX in the lowermost line the display panel 110 is disposed. However, the present disclosure is not limited thereto. The region of the dummy area DA may be variously changed.

Hereinafter, the drive circuit for operating one pixel will be described in more detail with reference to FIG. 2.

Figure 2:
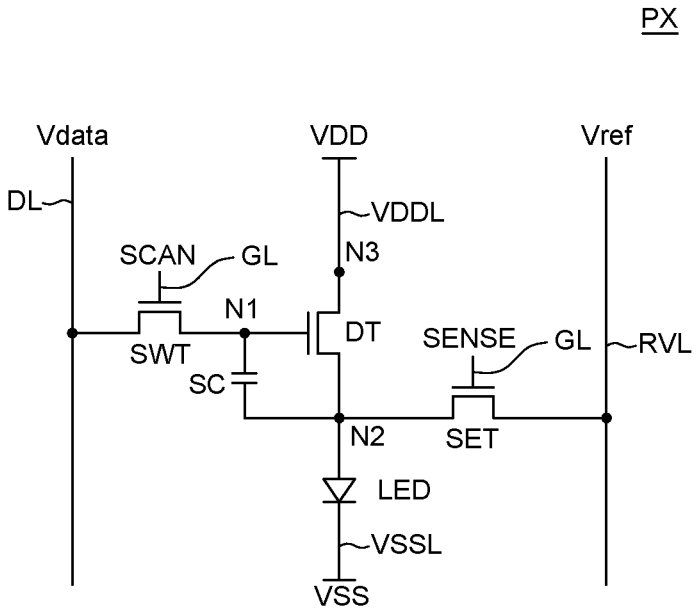
FIG. 2 is a circuit diagram of a pixel of the display device according to the embodiment of the present disclosure.

FIG. 2 is a circuit diagram illustrating the pixel of the display device according to the embodiment of the present disclosure.

FIG. 2 is a circuit diagram illustrating one pixel among the plurality of pixels of the display device 100.

Referring to FIG. 2, the pixel may include a switching transistor SWT, a sensing transistor SET, a driving transistor DT, a storage capacitor SC, and a light-emitting element LED in one embodiment.

The light-emitting element LED may include an anode, an organic layer, and a cathode. The organic layer may include various organic layers such as a hole injection layer, a hole transport layer, an organic light-emitting layer, an electron transport layer, and an electron injection layer. The anode of the light-emitting element LED may be connected to an output terminal of the driving transistor DT. A low-potential voltage VSS may be applied to the cathode through a low-potential voltage line VSSL. FIG. 2 illustrates that the light-emitting element LED is an organic light-emitting element. However, the present disclosure is not limited thereto. The light-emitting element LED may be changed to various elements configured to emit light.

The low-potential voltage line VSSL is a constant power line for applying a low-potential voltage that is constant power. The low-potential voltage line VSSL may be called a grounding terminal.

Referring to FIG. 2, the switching transistor SWT is a transistor for transmitting the data voltage Vdata to a first node N1 corresponding to the gate electrode of the driving transistor DT. The switching transistor SWT may include a drain electrode connected to the data line DL, a gate electrode connected to the gate line GL, and a source electrode connected to the gate electrode of the driving transistor DT. The switching transistor SWT may be turned on in response to a scan signal SCAN applied from the gate line GL and transmit the data voltage Vdata, which is supplied from the data line DL, to the first node N1 corresponding to the gate electrode of the driving transistor DT.

Referring to FIG. 2, the driving transistor DT is a transistor for operating the light-emitting element LED by supplying a drive current to the light-emitting element LED. The driving transistor DT may include a gate electrode corresponding to the first node N1, a source electrode corresponding to a second node N2 and an output terminal, and a drain electrode corresponding to a third node N3 and an input terminal. The gate electrode of the driving transistor DT may be connected to the switching transistor SWT. The drain electrode may receive a high-potential voltage VDD through a high-potential voltage line VDDL. The source electrode may be connected to the anode of the light-emitting element LED.

Referring to FIG. 2, the storage capacitor SC is a capacitor for maintaining, for one frame, a voltage corresponding to the data voltage Vdata. A first electrode of the storage capacitor SC may be connected to the first node N1. A second electrode of the storage capacitor SC may be connected to the second node N2.

Meanwhile, in the case of the display device 100, the circuit element such as the driving transistor DT may degrade as the operating time of each of the pixels increases. Therefore, an inherent characteristic value of the circuit element such as the driving transistor DT may change. In this case, the inherent characteristic values of the circuit element may include the threshold voltage Vth of the driving transistor DT, mobility a of the driving transistor DT, and the like. A change in characteristic value of the circuit element may cause a change in brightness of the corresponding pixel. Therefore, the change in characteristic value of the circuit element may be used as the same concept as the change in brightness of the pixel.

In addition, a degree of the change in characteristic values between the circuit elements of each of the pixels may vary depending on a difference in degree of degradation between the circuit elements. A difference in degree of change in characteristic values between the circuit elements may cause a brightness deviation between the pixels. Therefore, the deviation of characteristic values between the circuit element may be used as the same concept as the brightness deviation between the pixels. The change in characteristic value of the circuit element such as the deviation between the change in brightness of the pixel and the characteristic values between the circuit elements and/or the brightness deviation between the pixels may cause problems such as deterioration accuracy of brightness expression of the pixel or screen abnormality.

Therefore, a sensing function of sensing the characteristic values of the pixels and a compensation function of compensating for the characteristic value of the pixel by using the sensing result may be provided to the pixels of the display device 100 according to the embodiment of the present disclosure.

Therefore, as illustrated in FIG. 2, in addition to the switching transistor SWT, the driving transistor DT, the storage capacitor SC, and the light-emitting element LED, the pixel PX may further include a sensing transistor SET for effectively controlling a voltage state of the source electrode of the driving transistor DT.

Referring to FIG. 2, the sensing transistor SET is connected to a reference voltage line RVL for supplying a reference voltage Vref to the source electrode of the driving transistor DT at second node N2. The gate electrode of the sensing transistor SET is connected to the gate line GL. Therefore, the sensing transistor SET may be turned on in response to a sensing signal SENSE applied through the gate line GL and apply the reference voltage Vref, which is supplied through the reference voltage line RVL, to the source electrode of the driving transistor DT. In addition, the sensing transistor SET may be used as one of the voltage sensing paths for sensing the source electrode of the driving transistor DT.

Referring to FIG. 2, the scan signal SCAN may be applied to the switching transistor SWT through the gate line GL. The sensing signal SENSE may be applied to the sensing transistor SET through the sensing line.

Therefore, the reference voltage Vref is applied to the source electrode of the driving transistor DT through the sensing transistor SET. Further, the sensing voltage for sensing the threshold voltage Vth of the driving transistor DT or the mobility a of the driving transistor DT is detected through the reference voltage line RVL. Further, the data driver 130 may compensate for the data voltage Vdata depending on the amount of detected change in threshold voltage Vth of the driving transistor DT or the amount of detected change in mobility a of the driving transistor DT.

Figure 3:
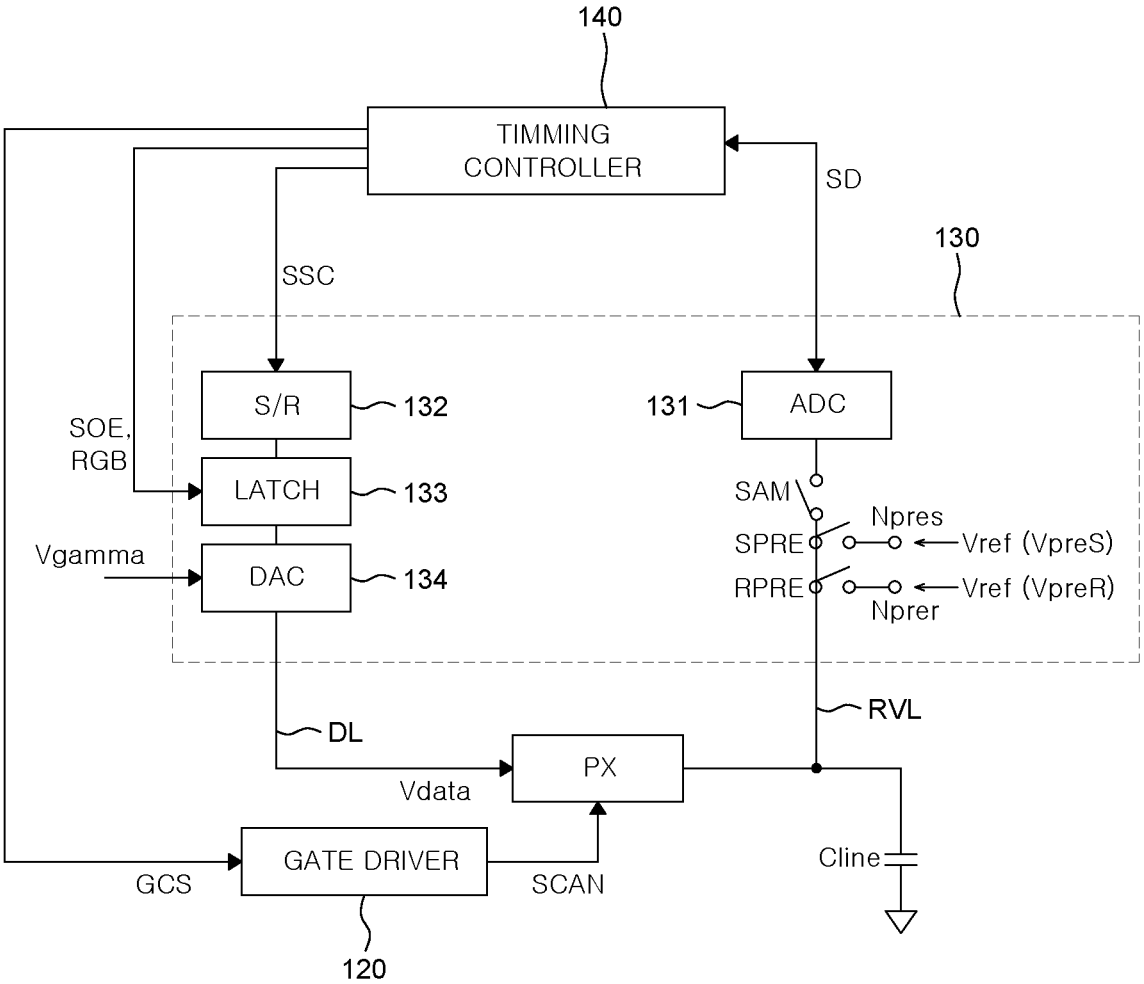
FIG. 3 is a block diagram illustrating a display panel of the display device according to the embodiment of the present disclosure.

FIG. 3 is a block diagram illustrating the display panel 110 of the display device according to the embodiment of the present disclosure.

As described above, the display device 100 according to the embodiment of the present disclosure may detect the characteristic value of the driving transistor DT in the pixel PX or the change in characteristic value from the sensing voltage of the reference voltage line RVL during a sensing period. Therefore, the reference voltage line RVL may not only serve to transmit the reference voltage Vref, but also serve as a sensing line for sensing the characteristic value of the driving transistor DT in the pixel PX. Therefore, the reference voltage line RVL may be called the sensing line.

Specifically, referring to FIGS. 2 and 3, in the sensing process of the display device 100 according to the embodiment of the present disclosure, the characteristic value of the driving transistor DT or the change in characteristic value may be a voltage (e.g., Vdata−Vth) of the second node N2 of the driving transistor DT.

The voltage of the second node N2 of the driving transistor DT may correspond to the sensing voltage of the reference voltage line RVL when the sensing transistor SET is in the turn-on state. In addition, a line capacitor Cline on the reference voltage line RVL may be charged by the voltage of the second node N2 of the driving transistor DT. With the charged line capacitor Cline, the reference voltage line RVL may have a sensing voltage corresponding to the voltage of the second node N2 of the driving transistor DT.

The display device 100 according to the embodiment of the present disclosure performs ON-OFF control on the switching transistor SWT and the sensing transistor SET in the pixel PX to be sensed and controls the supply of the data voltage Vdata and the reference voltage Vref. Therefore, the display device 100 may operate to implement a voltage state in which the second node N2 of the driving transistor DT reflects the characteristic value (threshold voltage, mobility) of the driving transistor DT or the change in characteristic value.

The data driver 130 of the display device 100 according to the embodiment of the present disclosure may include an analog-digital converter (ADC) 131 configured to measure the sensing voltage of the reference voltage line RVL corresponding to the voltage of the second node N2 of the driving transistor DT and convert the sensing voltage into a digital value and switch circuits SAM and SPRE for sensing the characteristic value of the driving transistor DT.

The switch circuits SAM and SPRE for controlling the sensing operation may include the sensing reference switch SPRE configured to control connection between the reference voltage line RVL and a sensing reference voltage supply node Npres for supplying the reference voltage Vref and a sampling switch SAM configured to control connection between the reference voltage line RVL and the ADC 131.

In this case, the sensing reference switch SPRE is a switch for controlling the sensing operation. The reference voltage Vref supplied to the reference voltage line RVL by the sensing reference switch SPRE is a sensing reference voltage VpreS.

Further, to implement the image, the data driver 130 may include a shift register 132, a latch part 133, a digital-analog converter DAC 134, and a switch RPRE for an image operation during which an image is displayed. In addition, the data driver 130 may further include buffer circuits.

The image driving reference switch RPRE may control connection between the reference voltage line RVL and an image driving reference voltage supply node Nprer for supplying the reference voltage Vref. The image driving reference switch RPRE is a switch used for the image operation. The reference voltage Vref supplied to the reference voltage line RVL by the image driving reference switch RPRE corresponds to an image driving reference voltage VpreR.

That is, the sensing reference switch SPRE, which is a first voltage switch, may apply the sensing reference voltage VpreS to the reference voltage line RVL for sensing the driving transistor DT. Further, the image driving reference switch RPRE, which is a second voltage switch, may apply the image driving reference voltage VpreR to the reference voltage line RVL for the image operation.

However, the ADC 131 and the various types of switches SAM, SPRE, and RPRE may be positioned outside the data driver 130.

In this case, the sensing reference switch SPRE and the image driving reference switch RPRE may be separately provided or integrally implemented. The sensing reference voltage VpreS and the image driving reference voltage VpreR may have the same voltage value or different voltage values.

Further, the shift register 132 shifts a sampling signal in accordance with a source sampling clock SSC of the data control signal DCS. In addition, when data, which exceed the number of latches of the latch part 133, are supplied, the shift register 132 generates a carry signal Carry.

The latch part 133 samples the image data RGB from the timing controller 140 in response to the sampling signal sequentially inputted from the shift register 132. The latch part 133 latches the image data RGB by 1 horizontal line and then simultaneously outputs the image data RGB for 1 horizontal line in a turn-on level section of a source output enable signal SOE.

The DAC 134 decodes the digital image data RGB inputted from the latch part 133 and outputs, as the data voltage Vdata, an analog gamma voltage Vgamma, which corresponds to gradation values of the image data RGB, to the data line DL.

With the above-mentioned series of processes, the data driver 130 of the display device 100 according to the embodiment of the present disclosure may process the image data RGB in response to the data control signal DSC and output the data voltage Vdata to the plurality of data lines DL.

More specifically, the data voltage Vdata may be outputted in the turn-on level section of the source output enable signal SOE.

Meanwhile, the gate driver 120 may sequentially output the scan signal SCAN in a turn-on level section of a gate output enable signal GOE. That is, the gate driver 120 of the display device 100 according to the embodiment of the present disclosure may output the scan signal SCAN in response to the gate control signal GCS.

Figure 4:
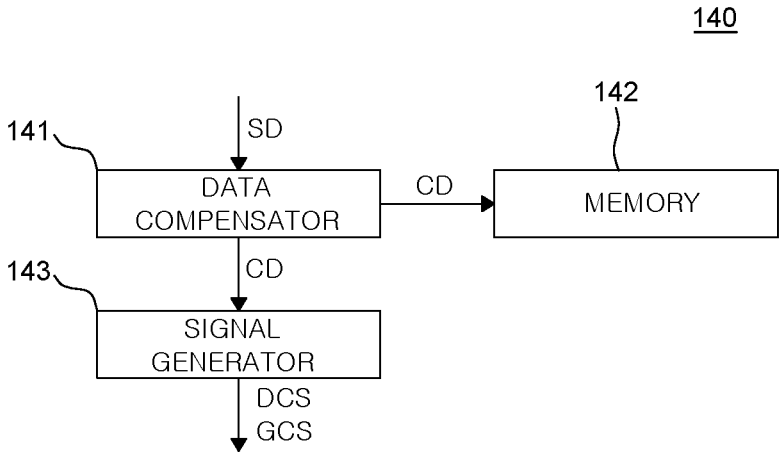
FIG. 4 is a block diagram illustrating a timing controller of the display device according to the embodiment of the present disclosure.

FIG. 4 is a block diagram illustrating the timing controller 140 of the display device according to the embodiment of the present disclosure.

The timing controller 140 includes a data compensator 141 configured to compensate for data, a memory 142 configured to store the data for a plurality of different periods of time (e.g., a long period of time or a short period of time that is shorter than the long period of time), and a signal generator 143 configured to generate the gate control signal GCS and the data control signal DCS.

The data compensator 141 may calculate compensation data CD according to sensing data SD outputted from the ADC 131. In one embodiment, the compensation data CD is calculated for both dummy pixels that do not emit light and light-emitting pixels.

Specifically, the data compensator 141 may compare the sensing data SD and reference data and calculate compensation data CD that reflect differences between the sensing data SD and the reference data. Further, the compensation data CD may be stored in the memory 142.

For example, the data compensator 141 calculates the compensation data CD at a positive level when the reference data is greater than the sensing data SD. In contrast, the data compensator 141 calculates the compensation data CD at a negative level when the reference data is less than the sensing data SD.

The memory 142 stores the sensing data SD outputted from the ADC 131 or stores the compensation data CD outputted from the data compensator 141.

The reference data may be stored in the memory 142. The reference data may include the mobility of the driving transistor in a basic state in which no degradation occurs, for example.

Meanwhile, the memory 142 may be positioned outside the timing controller 140 or implemented in the form of a register inside the timing controller 140.

The signal generator 143 may generate the gate control signal GCS and the data control signal DCS in order to control the charging rate of the data voltage Vdata according to the compensation data CD.

The charging rate of the data voltage Vdata may be determined depending on the degree to which the data voltage Vdata is applied in the turn-on level section of the scan signal SCAN that turns on at least one pixel that receives the scan signal SCN at the turn-on level. That is, the charging rate of the data voltage Vdata may increase as an overlap time between the turn-on level section of the scan signal SCAN and the output section of the data voltage Vdata increases.

The signal generator 143 may generate the gate control signal GCS and the data control signal DCS in order to control the overlap time between the turn-on level section of the scan signal SCAN that turns on at least one pixel that receives the scan signal SCN and the output section of the data voltage Vdata according to the compensation data CD. That is, an amount of time that the scan signal SCAN at the turn-on level that turns on at least one pixel is output while the data voltage Vdata is also output is adjusted based on the compensation data.

Specifically, when the compensation data CD at the positive level is applied to the signal generator 143, the gate control signal GCS and the data control signal DCS may be generated to decrease the overlap time between the turn-on level section of the scan signal SCAN and the output section of the data voltage Vdata while both the scan signal SCAN and the data voltage Vdata are output.

On the contrary, specifically, when the compensation data CD at the negative level is applied to the signal generator 143, the gate control signal GCS and the data control signal DCS may be generated to increase the overlap time between the turn-on level section of the scan signal SCAN and the output section of the data voltage Vdata while both the scan signal SCAN and the data voltage Vdata are output.

This configuration will be specifically described below with reference to FIGS. 7A to 8B.

Figure 5:
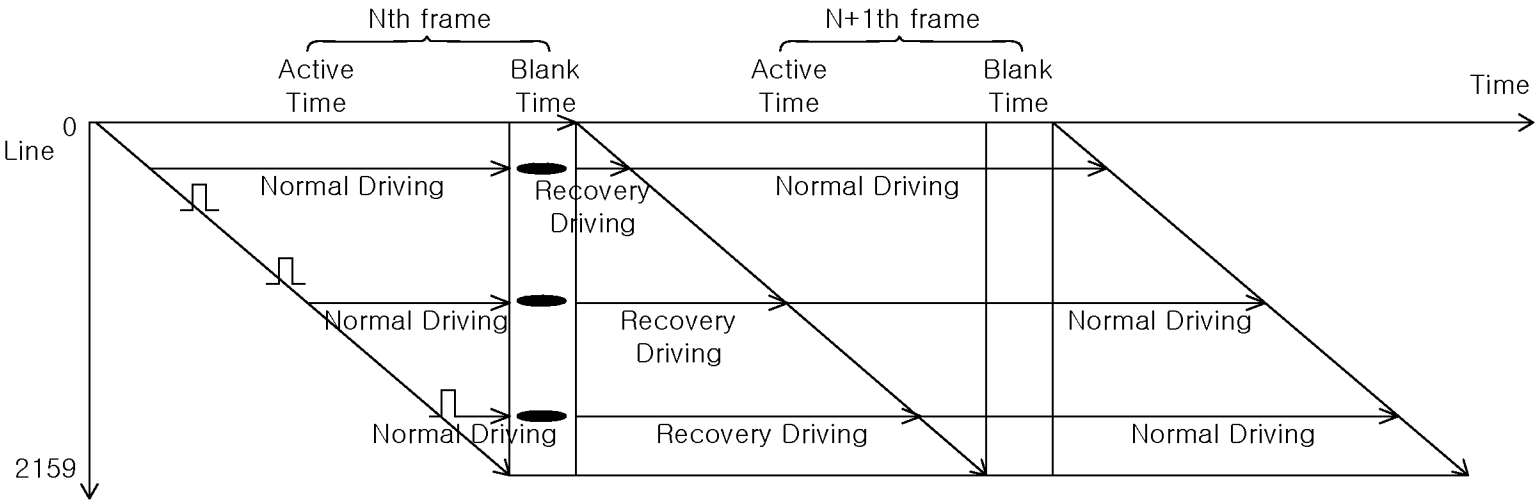
FIG. 5 is a graph for explaining operations of the display device according to the embodiment of the present disclosure for respective frames.

FIG. 5 is a graph for explaining operations of the display device according to the embodiment of the present disclosure for respective frames.

As illustrated in FIG. 5, the image operation data voltage Vdata is sequentially written to the pixels PX in the plurality of lines for an operating time (active time) of an Nth frame, such that the plurality of pixels PX may emit light. (Normal Driving)

Thereafter, the process of sensing the deviation of the characteristic value of the driving transistor disposed in the plurality of pixels PX in particular lines of the display panel is performed during a blank period (blank time) of the Nth frame. In this case, the sensing data voltage Vdata may be applied to the plurality of pixels PX in the particular lines. Further, the plurality of pixels PX does not emit light because the sensing process is performed.

Thereafter, the data voltage Vdata for recovery driving is written to the plurality of pixels PX in the particular lines on which the sensing process has been performed for the operating time (active time) of the Nth frame, such that the plurality of pixels PX may emit light. (Recovery Driving) The recovery driving data voltage Vdata may be equal to the image operation data voltage Vdata.

Further, the image data voltage Vdata, which is compensated by reflecting the sensing process, is sequentially written to the pixels PX in the plurality of lines for an operating time (active time) of a (N+1)th frame, such that the plurality of pixels PX may emit light. (Normal Driving)

Meanwhile, the sensing process performed for the blank period is called a real-time sensing process.

Meanwhile, the process of sensing a mobility value of a driving transistor DRT may be performed before the image operation starts after a power-on signal is generated. This sensing process is called on-sensing and an on-sensing process. Alternatively, the process of sensing the mobility value of the driving transistor DRT may be performed after a power-off signal is generated. This sensing and the sensing process are called off-sensing and an off-sensing process.

Hereinafter, an embodiment of a sensing process for a blank period (blank time) will be described with reference to FIG. 6.

Figure 6:
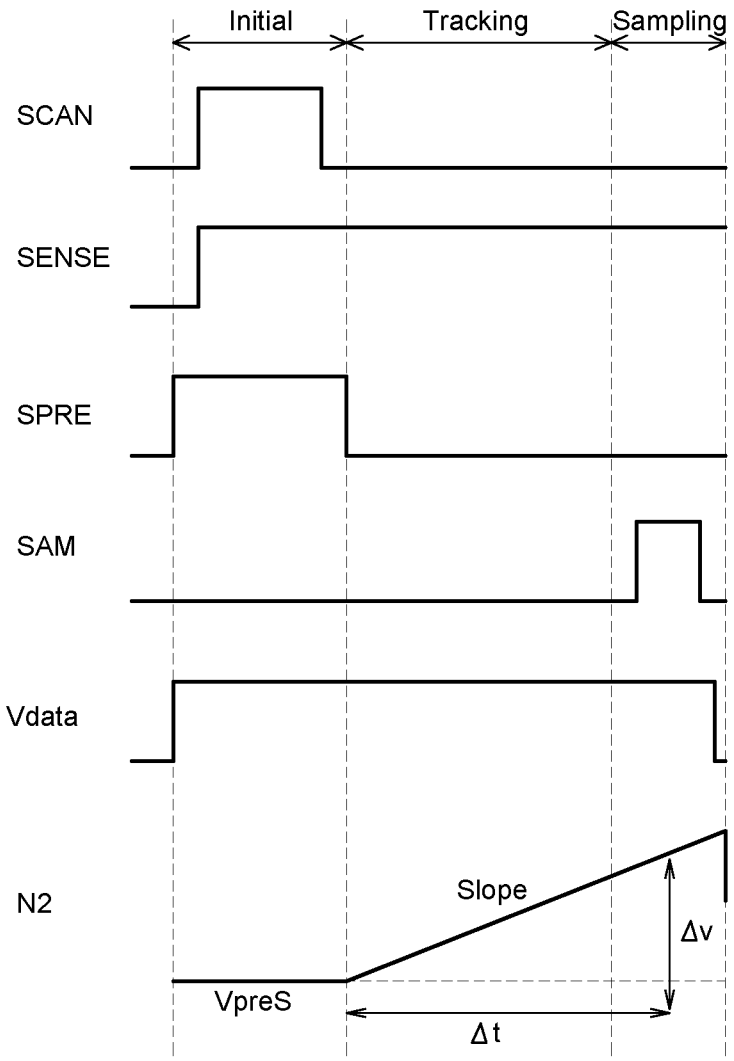
FIG. 6 is a signal timing diagram for explaining a sensing process during a blank period of the display device according to the embodiment of the present disclosure.

FIG. 6 is a signal timing diagram for explaining the sensing process for the blank period of the display device according to the embodiment of the present disclosure.

Referring to FIGS. 2, 3, and 6, in the display device according to the embodiment of the present disclosure, the process of sensing the mobility of the driving transistor DT for the blank period (blank time) may be performed through an initialization step (Initial), a tracking step (Tracking), and a sampling step (Sampling).

In the initialization step (Initial), the switching transistor SWT is turned on by the scan signal SCAN at the turn-on level, and the first node N1 of the driving transistor DT is initialized to the sensing data voltage Vdata for the mobility sensing.

In addition, the sensing transistor SET is turned on by the sensing signal SENSE at the turn-on level, and the sensing reference switch SPRE is turned on. In this state, the second node N2 of the driving transistor DT is initialized to the sensing reference voltage VpreS.

The tracking step (Tracking) is a step of tracking the mobility of the driving transistor DT. The mobility of the driving transistor DT may indicate a current driving ability of the driving transistor DT. The tracking step (Tracking) tracks the voltage of the second node N2 of the driving transistor DT that may calculate the mobility of the driving transistor DT.

In the tracking step (Tracking), the switching transistor SWT is turned off by the scan signal SCAN at the turn-off level, and the sensing reference switch SPRE transitions to the turn-off level. Therefore, both the first node N1 and the second node N2 of the driving transistor DT float, such that both the voltage of the first node N1 and the voltage of the second node N2 of the driving transistor DT increase. In particular, because the voltage of the second node N2 of the driving transistor DT has been initialized to the sensing reference voltage VpreS, the voltage begins to increase from the sensing reference voltage VpreS. In this case, because the sensing transistor SET is turned on, the increase in voltage of the second node N2 of the driving transistor DT leads to the increase in sensing voltage of the reference voltage line RVL.

In the sampling step (Sampling), the sampling switch SAM is turned on at a point in time at which a predetermined time Δelapses from a point in time at which the voltage of the second node N2 of the driving transistor DT begins to increase. In this case, the ADC 131 may sense the sensing voltage of the reference voltage line RVL connected by the sampling switch SAM and convert the analog sensing voltage into second sensing data in the form of digital signals. In this case, the sensing voltage applied to the ADC 131 corresponds to a level (VpreS+ΔV) increased by a predetermined voltage ΔV from the sensing reference voltage VpreS.

In this case, in the tracking step (Tracking), the mobility of the driving transistor DT is proportional to the amount of change in voltage per unit time (ΔV/Δt) of the reference voltage line RVL, i.e., proportional to a gradient (Slope) of a voltage waveform of the reference voltage line RVL.

That is, the sensing voltage may be sampled during the blank period when the sensing reference switch SPRE, which is the first voltage switch, is in the OFF state, and the sampling switch SAM is in the ON state after the image driving reference switch RPRE, which is the second voltage switch, switches from the ON state to the OFF state.

FIGS. 7A to 8B are signal timing diagrams for explaining the compensation process during the operating (active) time of the display device according to the embodiment of the present disclosure.

Figure 7A:
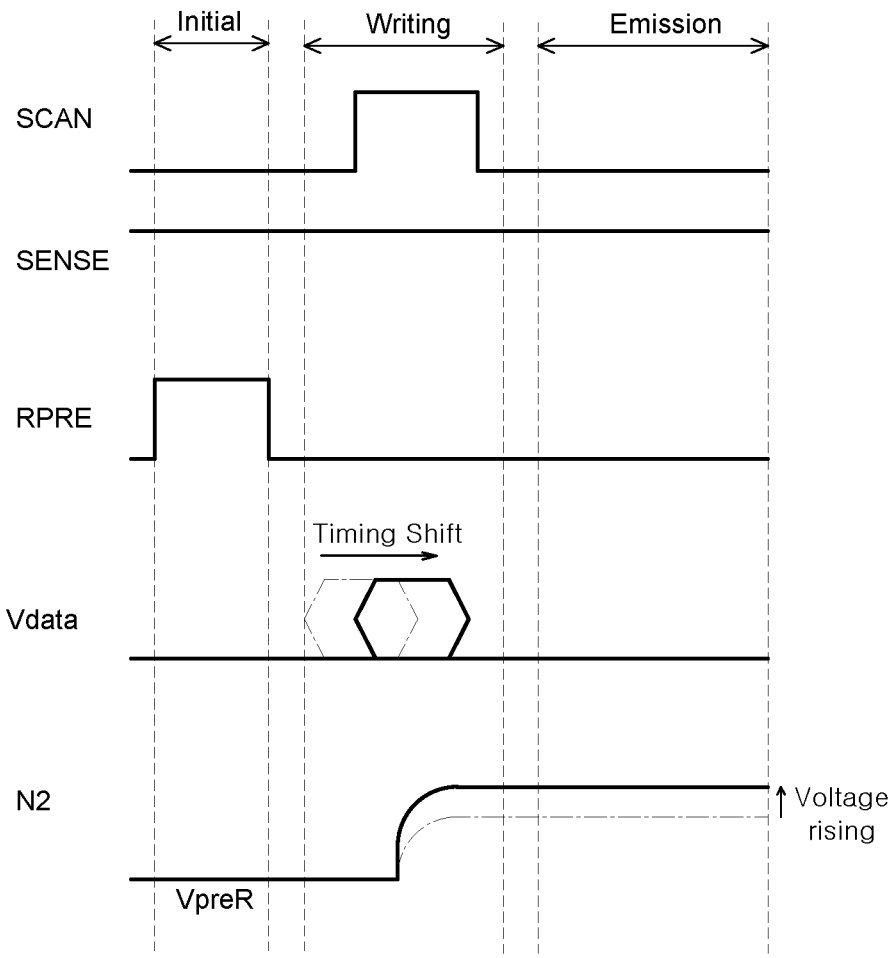
FIGS. 7A, 7B, 8A, and 8B are signal timing diagrams for explaining a compensation process during an operating time of the display device according to the embodiment of the present disclosure.
Figure 7B:
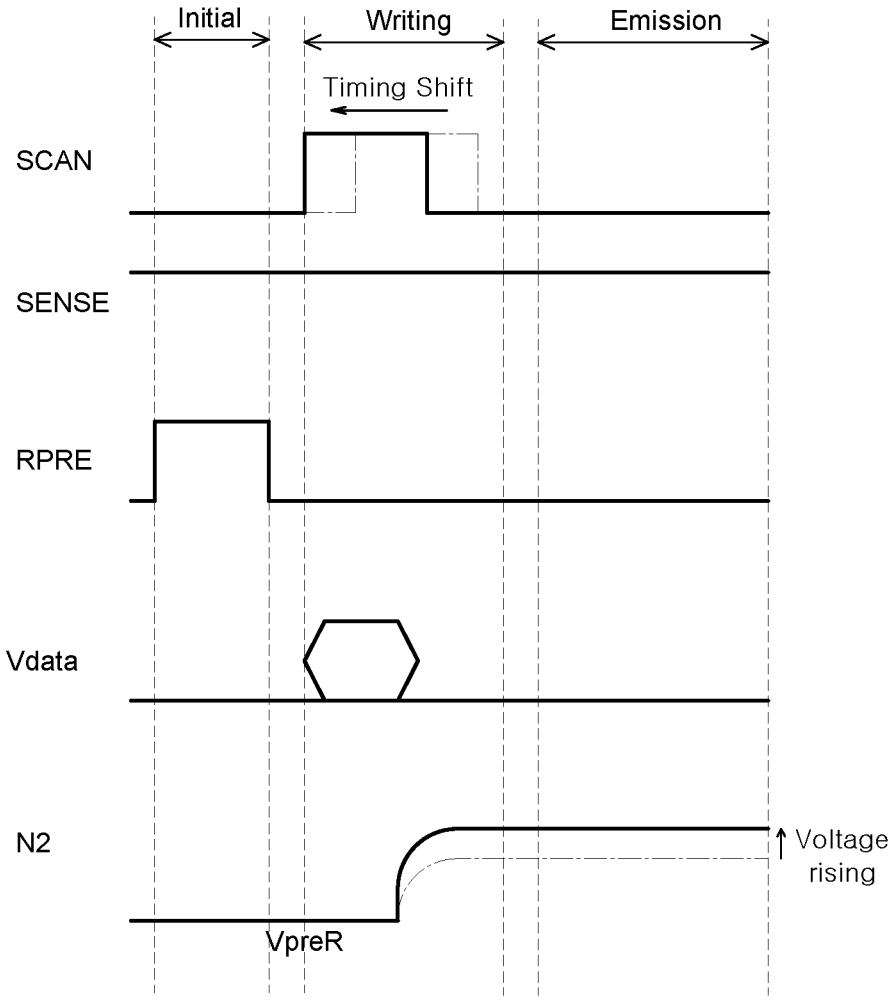
Figure 8A:
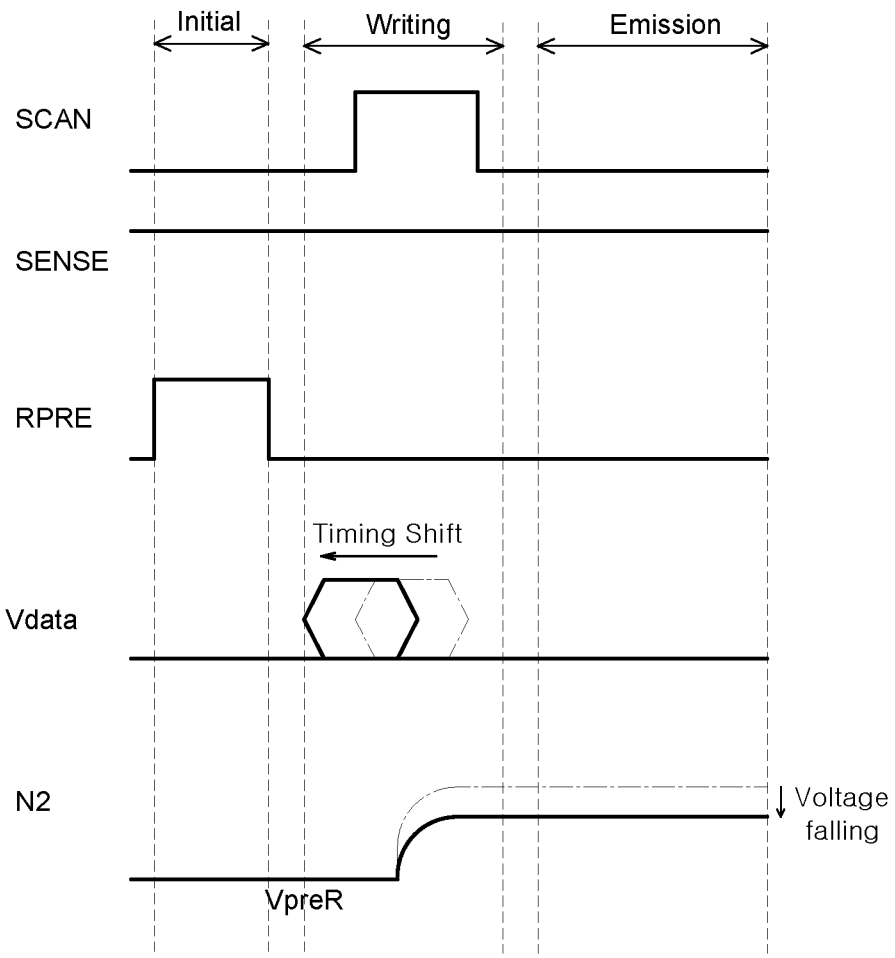
Figure 8B:
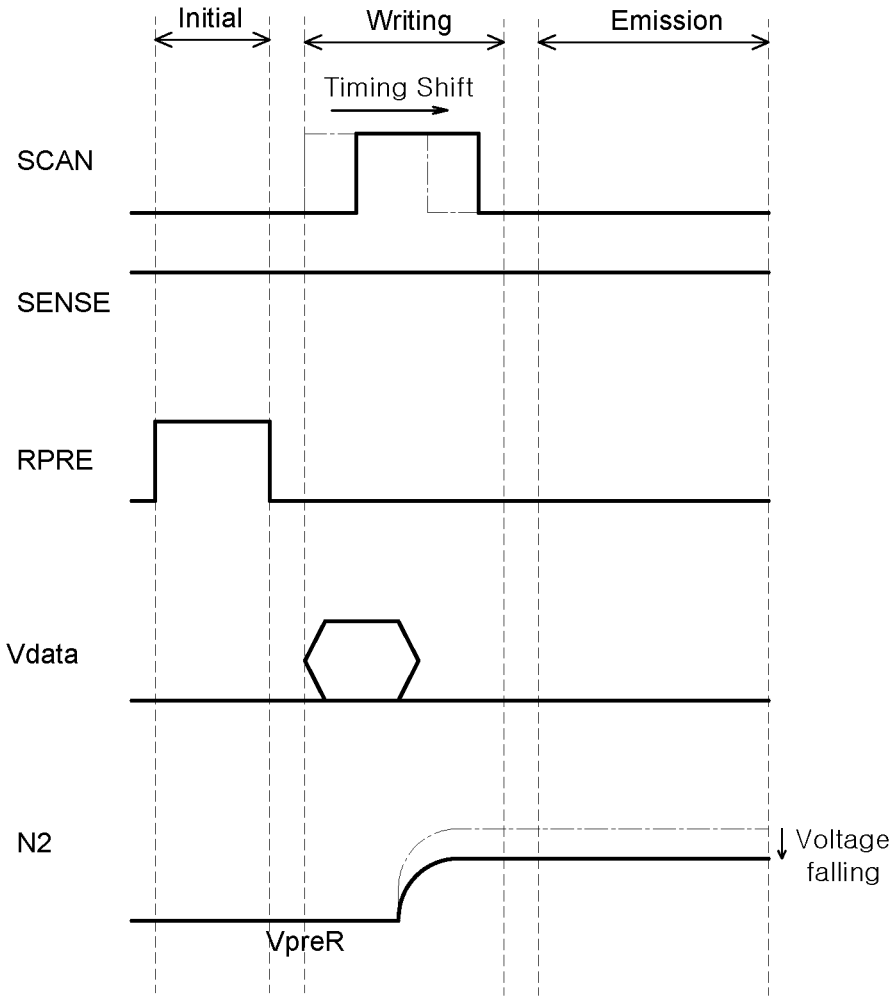

Specifically, FIGS. 7A to 7B are views for explaining the compensation process when the compensation data CD at the negative level are outputted. FIGS. 8A to 8B are views for explaining the compensation process when the compensation data CD at the positive level are outputted.

Referring to FIGS. 2, 3, 7A, and 7B, in the display device according to the embodiment of the present disclosure, an initialization step (Initial), a writing step (Writing), and a light-emitting step (Emission) may be performed during the operating time.

In the initialization step (Initial), the sensing transistor SET is turned on by the sensing signal SENSE at the turn-on level, and the driving reference switch RPRE is turned on. In this state, the second node N2 of the driving transistor DT is initialized to the driving reference voltage VpreR.

In the writing step (Writing), the switching transistor SWT is turned on by the scan signal SCAN at the turn-on level, and the data voltage Vdata is written to the first node N1 of the driving transistor DT.

Further, because the driving reference switch RPRE is turned off in the writing step (Writing), the second node N2 is charged with the voltage corresponding to a difference between the data voltage Vdata and the threshold voltage in accordance with the data voltage Vdata written to the first node N1.

In the light-emitting step (Tracking), the drive current flowing through the light-emitting element LED is determined depending on the voltage of the second node N2, such that the light-emitting element LED emits light.

However, because the sensing data SD is less than the reference data, the gate control signal GCS and the data control signal DCS may be generated to increase the overlap time between the turn-on level section of the scan signal SCAN and the output section of the data voltage Vdata when the compensation data CD at the negative level is generated. Thus, the amount of time that the scan signal SCAN is at the turn-on level and the data voltage Vdata is outputted while the scan signal SCAN is also output is increased responsive to the compensation data CD being at the negative level.

Therefore, as illustrated in FIG. 7A, the output timing of the data voltage Vdata may be delayed in response to the data control signal DCS.

Alternatively, as illustrated in FIG. 7B, the turn-on timing of the scan signal SCAN may be advanced in response to the gate control signal GCS. In this case, a duty of the scan signal SCAN may be constant. However, the present disclosure is not limited thereto. The duty of the scan signal SCAN may increase.

Therefore, as described above, the overlap time between the turn-on level section of the scan signal SCAN and the output section of the data voltage Vdata may be increased by controlling the gate control signal GCS and the data control signal DCS.

Therefore, the charging rate of the data voltage Vdata applied to the second node N2 may increase. Therefore, the drive current flowing through the light-emitting element LED increases, such that the output brightness may increase.

That is, in the case of a display device in the related art, a turn-on timing of a scan signal and an output timing of a data voltage are fixed. For this reason, there is a problem in that when mobility of a driving transistor decreases, a voltage with which a source electrode of the driving transistor is charged decreases as indicated by the dotted line, which decreases output brightness.

In contrast, in the case of the display device 100 according to the embodiment of the present disclosure, when the mobility of the driving transistor decreases, the turn-on timing of the scan signal and the output timing of the data voltage are adjusted, such that the output brightness may be compensated by increasing the voltage with which the source electrode of the driving transistor is charged, as indicated by the solid line.

Referring to FIGS. 2, 3, 8A, and 8B, in the display device according to the embodiment of the present disclosure, an initialization step (Initial), a writing step (Writing), and a light-emitting step (Emission) may be performed during the operating time.

In the initialization step (Initial), the sensing transistor SET is turned on by the sensing signal SENSE at the turn-on level, and the driving reference switch RPRE is turned on. In this state, the second node N2 of the driving transistor DT is initialized to the driving reference voltage VpreR.

In the writing step (Writing), the switching transistor SWT is turned on by the scan signal SCAN at the turn-on level, and the data voltage Vdata is written to the first node N1 of the driving transistor DT.

Further, because the driving reference switch RPRE is turned off in the writing step (Writing), the second node N2 is charged with the voltage corresponding to a difference between the data voltage Vdata and the threshold voltage in accordance with the data voltage Vdata written to the first node N1.

In the light-emitting step (Tracking), the drive current flowing through the light-emitting element LED is determined depending on the voltage of the second node N2, such that the light-emitting element LED emits light.

However, because the sensing data SD is greater than the reference data, the gate control signal GCS and the data control signal DCS may be generated to decrease the overlap time between the turn-on level section of the scan signal SCAN and the output section of the data voltage Vdata when the compensation data CD at the positive level is generated. Thus, the amount of time that the scan signal SCAN is at the turn-on level and the data voltage Vdata is outputted while the scan signal SCAN is also output is decreased responsive to the compensation data CD being at the positive level.

Therefore, as illustrated in FIG. 8A, the output timing of the data voltage Vdata may be advanced in response to the data control signal DCS.

Alternatively, as illustrated in FIG. 8B, the turn-on timing of the scan signal SCAN may be delayed in response to the gate control signal GCS. In this case, a duty of the scan signal SCAN may be constant. However, the present disclosure is not limited thereto. The duty of the scan signal SCAN may decrease.

Therefore, as described above, the overlap time between the turn-on level section of the scan signal SCAN and the output section of the data voltage Vdata may be decreased by controlling the gate control signal GCS and the data control signal DCS.

Therefore, the charging rate of the data voltage Vdata applied to the second node N2 may decrease. Therefore, the drive current flowing through the light-emitting element LED decreases, such that the output brightness may decrease.

That is, in the case of a display device in the related art, a turn-on timing of a scan signal and an output timing of a data voltage are fixed and cannot be adjusted. For this reason, there is a problem in that when mobility of a driving transistor increases, a voltage with which a source electrode of the driving transistor is charged increases as indicated by the dotted line, which increases output brightness.

In contrast, in the case of the display device according to the embodiment of the present disclosure, when the mobility of the driving transistor increases, the turn-on timing of the scan signal and the output timing of the data voltage are changed, such that the output brightness may be compensated by decreasing the voltage with which the source electrode of the driving transistor is charged, as indicated by the solid line.

Figure 9A:
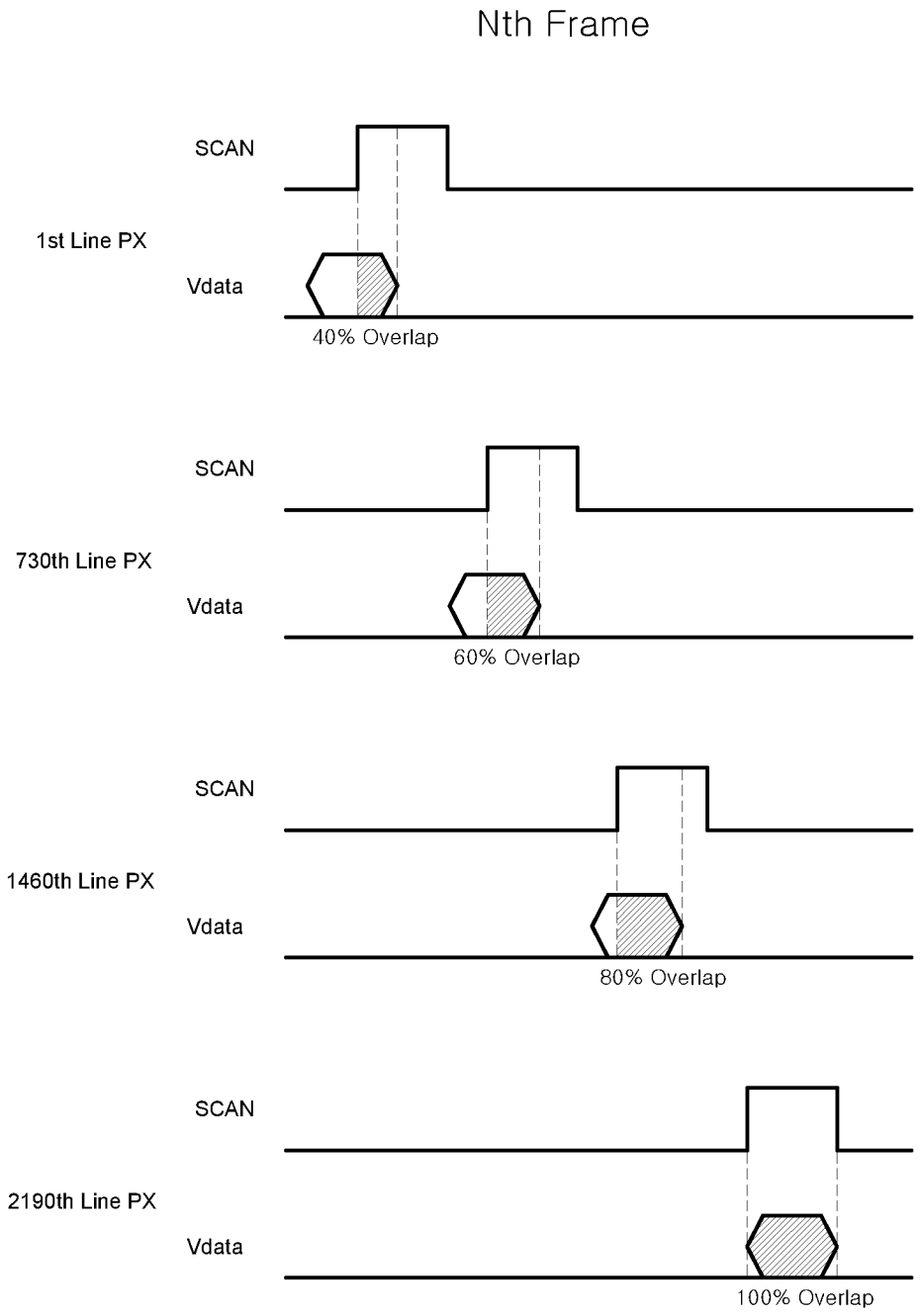
FIGS. 9A and 9B are signal timing diagrams for explaining a compensation process in pixels in a plurality of lines of the display device according to the embodiment of the present disclosure.
Figure 9B:
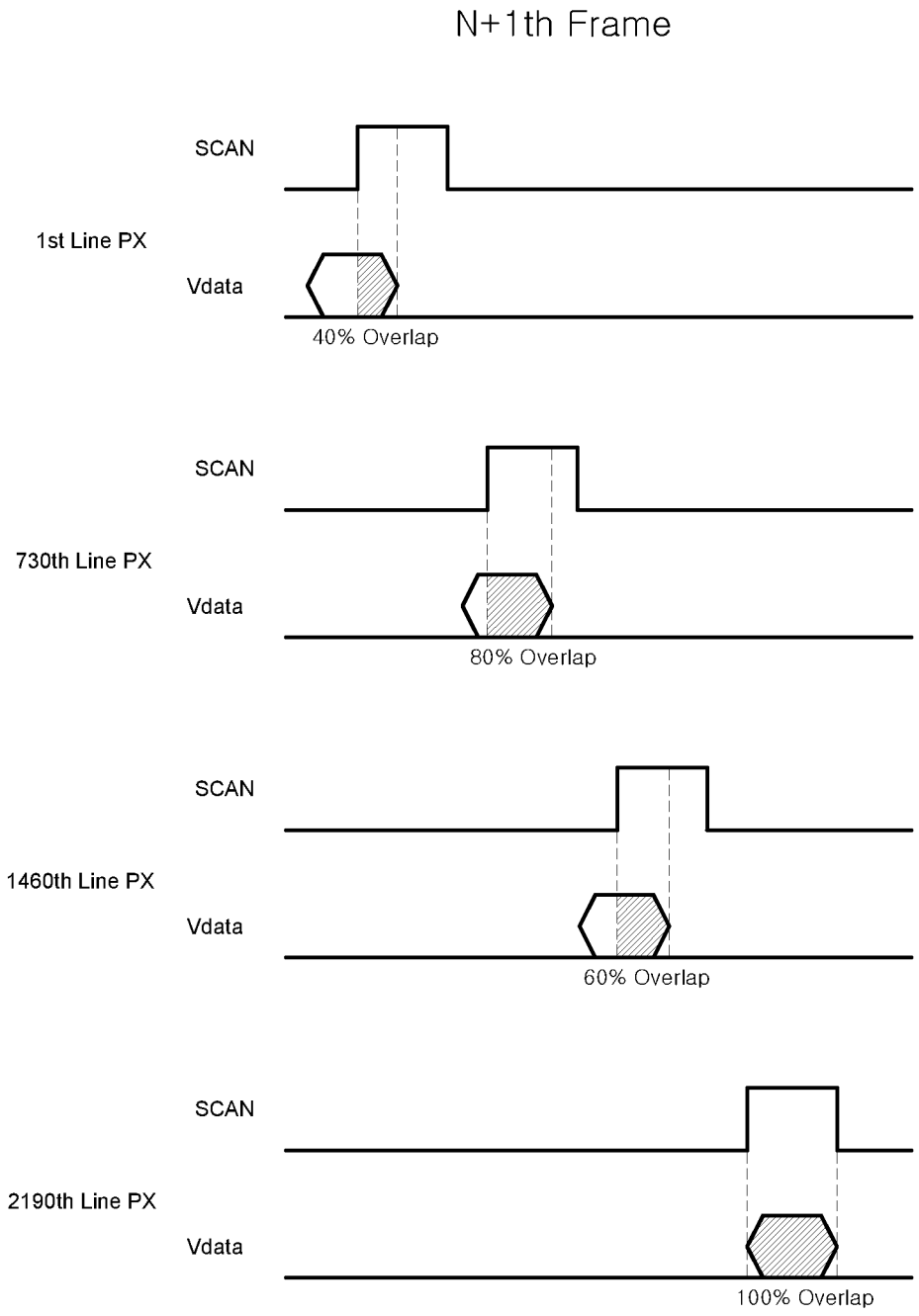

FIGS. 9A and 9B are signal timing diagrams for explaining a compensation process in pixels in a plurality of lines of the display device according to the embodiment of the present disclosure.

Specifically, FIG. 9A is a view for explaining the compensation process in the pixels PX in the plurality of lines disposed in the display area AA in the Nth frame. FIG. 9B is a view for explaining the compensation process in the pixels PX in the plurality of lines disposed in the display area AA in the (N+1)th frame.

However, FIG. 9B may be not only used for explaining the (N+1)th frame, but also used for explaining a (N+k)th frame. Here, k is a natural number of 2 or more.

Further, FIGS. 9A and 9B illustrate the scan signal SCAN and the data voltage Vdata applied to the pixel in the first line, the pixel in the 730th line, the pixel in the 1460th line, and the pixel in the 2190th line among the pixels PX in the plurality of lines disposed in the display area AA.

As illustrated in FIGS. 1, 9A, and 9B, the pixel PX in the uppermost line in the dummy area DA may be sensed, and the gate control signal GCS and the data control signal DCS may be controlled based on the compensation data for the pixel PX in the first line so that the overlap time between the output section of the data voltage Vdata and the turn-on level section of the scan signal SCAN outputted to the pixel in the first line, which is the uppermost line in the display area AA, is 40%.

As illustrated in FIGS. 1, 9A, and 9B, the pixel PX in the lowermost line in the dummy area DA may be sensed, and the gate control signal GCS and the data control signal DCS may be controlled based on the compensation data for the pixel PX in the lowermost line so that the overlap time between the output section of the data voltage Vdata and the turn-on level section of the scan signal SCAN outputted to the pixel in the 2190th line, which is the lowermost line in the display area AA, is 100%.

Further, the overlap time between the output section of the data voltage Vdata and the turn-on level section of the scan signal SCAN outputted to the pixel in the intermediate line disposed in the display area AA may be provided between the overlap time between the output section of the data voltage Vdata and the turn-on level section of the scan signal SCAN outputted to the pixel in the first line, (e.g., the uppermost line) and the overlap time between the output section of the data voltage Vdata and the turn-on level section of the scan signal SCAN outputted to the pixel in the 2190th line (e.g., the lowermost line).

More specifically, the overlap time between the output section of the data voltage Vdata and the turn-on level section of the scan signal SCAN outputted to the pixel in the intermediate line may be calculated by linear interpolation according to the overlap time between the output section of the data voltage Vdata and the turn-on level section of the scan signal SCAN outputted to the pixel in the first line (e.g., the uppermost line) and the overlap time between the output section of the data voltage Vdata and the turn-on level section of the scan signal SCAN outputted to the pixel in the 2190th line (e.g., the lowermost line). Thus, the overlap time for the pixel in the first line and the pixel in the lowermost line sets the bounds of the overlap times for the pixels disposed in intermediate lines of the display panel.

For example, as illustrated in FIG. 9A, the gate control signal GCS and the data control signal DCS may be controlled so that the overlap time between the output section of the data voltage Vdata and the turn-on level section of the scan signal SCAN outputted to the pixel in the 730th line is 60%.

Further, the gate control signal GCS and the data control signal DCS may be controlled so that the overlap time between the output section of the data voltage Vdata and the turn-on level section of the scan signal SCAN outputted to the pixel in the 1460th line is 80%.

Meanwhile, in the plurality of adjacent frames, the overlap time between the output section of the data voltage Vdata and the turn-on level section of the scan signal SCAN outputted to the pixel in one line in one frame may be different from the overlap time between the output section of the data voltage Vdata and the turn-on level section of the scan signal SCAN outputted to the pixel in one line in another frame.

For example, referring to FIG. 9A, the overlap time between the output section of the data voltage Vdata and the turn-on level section of the scan signal SCAN outputted to the pixel in the 730th line in the Nth frame is 60%.

In contrast, referring to FIG. 9B, the overlap time between the output section of the data voltage Vdata and the turn-on level section of the scan signal SCAN outputted to the pixel in the 730th line in the (N+1)th frame may be adjusted to 80% which is within the bounds of the overlap time determined in the Nth frame.

For example, referring to FIG. 9A, the overlap time between the output section of the data voltage Vdata and the turn-on level section of the scan signal SCAN outputted to the pixel in the 1460th line in the Nth frame is 80% which is within the bounds of the overlap time determined in the Nth frame.

In contrast, referring to FIG. 9B, the overlap time between the output section of the data voltage Vdata and the turn-on level section of the scan signal SCAN outputted to the pixel in the 1460th line in the (N+1)th frame may be adjusted to 60%.

Therefore, the display device according to the embodiment of the present disclosure described above may compensate for the data charging rate. However, the process of compensating for the data charging rate of the pixel in the intermediate line may be variously changed without being limited thereto.

The exemplary embodiments of the present disclosure can also be described as follows:

According to an aspect of the present disclosure, a display device includes: a display panel on which a plurality of pixels is disposed; a data driver configured to receive a sensing voltage from a reference voltage line connected to the plurality of pixels, convert the sensing voltage into sensing data, and supply the data voltage to the plurality of pixels; a gate driver configured to supply a scan signal to the plurality of pixels; and a timing controller configured to output a data control signal for controlling an output timing of the data voltage by using the sensing data and output a gate control signal for controlling an output timing of the scan signal.

The timing controller may comprise a data compensator configured to compare the sensing data and reference data to output compensation data; and a signal generator configured to output the data control signal and the gate control signal according to the compensation data.

The timing controller may further comprise a memory configured to store the compensation data.

When the sensing data are higher than the reference data, an overlap time between a turn-on level section of the scan signal and an output section of the data voltage may decrease.

A turn-on timing of the scan signal may be retarded in response to the gate control signal.

The output timing of the data voltage may be advanced in response to the data control signal.

When the sensing data are lower than the reference data, an overlap time between a turn-on level section of the scan signal and an output section of the data voltage may increase.

A turn-on timing of the scan signal may be advanced in response to the gate control signal.

The output timing of the data voltage may be retarded in response to the data control signal.

The display panel may comprise a display area in which light-emitting pixels among the plurality of pixels are disposed; and a dummy area in which non-light-emitting pixels among the plurality of pixels are disposed.

A sensing voltage may be sampled from a reference voltage line connected to the non-light-emitting pixel disposed in the dummy area.

The timing controller may calculate sensing data from the non-light-emitting pixels disposed in the dummy area and outputs the gate control signal and the data control signal to control an overlap time between an output section of the data voltage and a turn-on level section of the scan signal outputted to the light-emitting pixel disposed in the display area.

An overlap time between the output section of the data voltage and a turn-on level section of a scan signal outputted to a light-emitting pixel in an intermediate line disposed in the display area may be calculated by linear interpolation according to an overlap time between the output section of the data voltage and a turn-on level section of a scan signal outputted to a light-emitting pixel in an uppermost line disposed in the display area and an overlap time of the output section of the data voltage and a turn-on level section of a scan signal outputted to a light-emitting pixel in a lowermost line disposed in the display area.

The overlap time between the output section of the data voltage and the turn-on level section of the scan signal outputted to the pixel in one line disposed on the display panel in a first frame may be different from the overlap time between the output section of the data voltage and the turn-on level section of the scan signal outputted to the pixel in one line disposed on the display panel in a second frame.

Although the exemplary embodiments of the present disclosure have been described in detail with reference to the accompanying drawings, the present disclosure is not limited thereto and may be embodied in many different forms without departing from the technical concept of the present disclosure. Therefore, the exemplary embodiments of the present disclosure are provided for illustrative purposes only but not intended to limit the technical concept of the present disclosure. The scope of the technical concept of the present disclosure is not limited thereto. Therefore, it could be understood that the above-described exemplary embodiments are illustrative in all aspects and do not limit the present disclosure. The protective scope of the present disclosure could be construed based on the following claims, and all the technical concepts in the equivalent scope thereof could be construed as falling within the scope of the present disclosure.

What is claimed is:

1. A display device comprising:

a display panel including a plurality of pixels;

a data driver configured to receive a sensing voltage from a reference voltage line connected to the plurality of pixels, convert the sensing voltage into sensing data, and supply data voltages to the plurality of pixels;

a gate driver configured to supply a scan signal to the plurality of pixels; and a timing controller configured to output a data control signal that controls an output timing of the data voltage and output a gate control signal that controls an output timing of the scan signal, wherein one of the output timing of the data voltage and the output timing of the scan signal is adjusted based on the sensing data, wherein the display panel further comprises:

a display area in which light-emitting pixels among the plurality of pixels are disposed, the light-emitting pixels configured to emit light; and a dummy area in which non-light-emitting pixels among the plurality of pixels are disposed, the non-light emitting pixels configured not to emit light, wherein a sensing voltage is sampled from another reference voltage line that is connected to the non-light-emitting pixels disposed in the dummy area, and wherein the timing controller receives sensing data from the non-light-emitting pixels in the dummy area based on the sampled sensing voltage and outputs the gate control signal and the data control signal to control an overlap time between an output section of the data voltage and a turn-on level section of the scan signal that turns on the light-emitting pixels in the display area.

2. The display device of claim 1, wherein the timing controller comprises:

a data compensator configured to compare the sensing data and reference data, and output compensation data based on the comparison; and a signal generator configured to output the data control signal and the gate control signal according to the compensation data.

3. The display device of claim 2, wherein the timing controller further comprises:

a memory configured to store the compensation data.

4. The display device of claim 2, wherein an overlap time between a turn-on level section of the scan signal that turns on the plurality of pixels and an output section of the data voltage decreases responsive to the sensing data being greater than the reference data.

5. The display device of claim 4, wherein the output timing of the scan signal is delayed responsive to the gate control signal.

6. The display device of claim 4, wherein the output timing of the data voltage is advanced responsive to the data control signal.

7. The display device of claim 2, wherein an overlap time between a turn-on level section of the scan signal that turns on the plurality of pixels and an output section of the data voltage increases responsive to the sensing data being less than the reference data.

8. The display device of claim 7, wherein the output timing of the scan signal is advanced responsive to the gate control signal.

9. The display device of claim 7, wherein the output timing of the data voltage is delayed responsive to the data control signal.

10. The display device of claim 1, wherein an overlap time between the output section of the data voltage and the turn-on level section of the scan signal outputted to a light-emitting pixel from the light-emitting pixels in the display area is calculated by linear interpolation according to an overlap time between an output section of a data voltage and a turn-on level section of a scan signal outputted to a first non-light-emitting pixel in an uppermost line in the display area and an overlap time of an output section of a data voltage and a turn-on level section of a scan signal outputted to a second non-light-emitting pixel in a lowermost line disposed in the display area.

11. The display device of claim 1, wherein an overlap time between an output section of a data voltage and a turn-on level section of a scan signal that turns on a pixel in one line disposed on the display panel in a first frame is different from an overlap time between an output section of the data voltage and the turn-on level section of the scan signal outputted to the pixel in the one line in a second frame that is different from the first frame.

12. A display device comprising:

a display panel including a plurality of pixels;

a data driver configured to supply data voltages to the plurality of pixels and generate sensing data indicative of a characteristic value of a pixel of the plurality of pixels based on a sensed voltage of the pixel received from a reference voltage line that is connected to the pixel;

a gate driver configured to supply a scan signal to the plurality of pixels; and a timing controller configured generate compensation data that compensates the characteristic value of the pixel and adjusts an amount of overlap time that a data voltage for the pixel is output while the scan signal is also output to the pixel based on the compensation data, wherein the display panel further comprises: a display area in which light-emitting pixels among the plurality of pixels are disposed, the light-emitting pixels configured to emit light; and a dummy area in which non-light-emitting pixels among the plurality of pixels are disposed, the non-light emitting pixels configured not to emit light, wherein a sensing voltage is sampled from another reference voltage line that is connected to the non-light-emitting pixels disposed in the dummy area, and wherein the timing controller receives sensing data from the non-light-emitting pixels in the dummy area based on the sampled sensing voltage and outputs a gate control signal and a data control signal to control an overlap time between an output section of the data voltage and a turn-on level section of the scan signal that turns on the light-emitting pixels in the display area.

13. The display device of claim 12, wherein the timing controller is configured to generate the compensation data by comparing the sensing data and reference data.

14. The display device of claim 13, wherein the timing controller is configured to decrease the amount of overlap time that the data voltage for the pixel is output while the scan signal is also output to the pixel responsive to the sensing data being greater than the reference data.

15. The display device of claim 13, wherein the timing controller is configured to increase the amount of overlap time that the data voltage for the pixel is output while the scan signal is also output to the pixel responsive to the sensing data being less than the reference data.

16. A display device comprising:

a display panel including a plurality of first pixels configured not to emit light and a plurality of second pixels configured to emit light;

a data driver configured to supply data voltages to the plurality of first pixels and the plurality of second pixels, and generate first sensing data indicative of first characteristic values of the plurality of first pixels, and generate second sensing data indicative of second characteristic values of the plurality of second pixels;

a gate driver configured to supply scan signals to the plurality of first pixels and the plurality of second pixels; and a timing controller configured to determine amounts of overlap time that first data voltages for the plurality of first pixels are output while first scan signals are also output to the plurality of first pixels based on the first sensing data, and adjust an amount of overlap time that a second data voltage for a second pixel from the plurality of second pixels is output while a scan signal is also output to the second pixel based on at least the determined amounts of overlap time for the plurality of first pixels that do not emit light.

17. The display device of claim 16, wherein the timing controller is configured to determine the amounts of overlap time by:

determining a first amount of overlap time that one data voltage from the first data voltages is output to a first line of first pixels from the plurality of first pixels while a first scan signal from the first scan signals is also output to the first line of first pixels;

determining a second amount of overlap time that another data voltage from the first data voltages is output to a second line of first pixels from the plurality of first pixels while a second scan signal from the first scan signals is also output to the second line of first pixels, wherein the amount of overlap time that the second data voltage for the second pixel is output while the scan signal is also output to the second pixel is based on a linear interpolation of the first amount of overlap time and the second amount of overlap time.

18. The display device of claim 17, wherein the first line of first pixels is an uppermost line of pixels in the display panel and the second line of second pixels is a lowermost line of pixels in the display panel.

* * * * *